US007429835B2

(12) United States Patent
Chang et al.

(10) Patent No.: US 7,429,835 B2
(45) Date of Patent: Sep. 30, 2008

(54) BACKLIGHT MODULE DRIVER CIRCUIT

(75) Inventors: Shu-Ming Chang, Hsinhua (TW); Yu-Pei Huang, Hsinhua (TW); Shen-Yao Liang, Hsinhua (TW); Shwang-Shi Bai, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 18 days.

(21) Appl. No.: 11/509,500

(22) Filed: Aug. 24, 2006

(65) Prior Publication Data

US 2007/0182697 A1 Aug. 9, 2007

(30) Foreign Application Priority Data

Feb. 7, 2006 (TW) ..... 95104084 A

(51) Int. Cl.
*H05B 39/04* (2006.01)
*H05J 11/04* (2006.01)

(52) U.S. Cl. ..... 315/312; 315/307

(58) Field of Classification Search ..... 315/276–277, 315/312, 307, 324, 320; 345/55, 84, 87, 345/102

See application file for complete search history.

(56) References Cited

U.S. PATENT DOCUMENTS

| | | | | |
|---|---|---|---|---|
| 5,808,423 | A * | 9/1998 | Li et al. | 315/313 |
| 5,814,947 | A * | 9/1998 | Brownell | 315/169.3 |
| 6,515,427 | B2 * | 2/2003 | Oura et al. | 315/141 |
| 6,534,927 | B1 * | 3/2003 | Takaoka | 315/224 |
| 7,042,171 | B1 * | 5/2006 | Lin | 315/291 |
| 7,205,724 | B2 * | 4/2007 | Ahn et al. | 315/209 R |
| 7,282,868 | B2 * | 10/2007 | Ushijima et al. | 315/277 |
| 7,291,987 | B2 * | 11/2007 | Chang et al. | 315/282 |
| 7,294,971 | B2 * | 11/2007 | Jin | 315/177 |
| 7,362,059 | B2 | 4/2008 | Park | |

FOREIGN PATENT DOCUMENTS

| | | |
|---|---|---|
| CN | 1670575 A | 9/2005 |
| CN | 1683971 A | 10/2005 |

* cited by examiner

*Primary Examiner*—Douglas W. Owens
*Assistant Examiner*—Minh Dieu A
(74) *Attorney, Agent, or Firm*—The Webb Law Firm

(57) ABSTRACT

A backlight driver circuit has a transformer, a switching circuit and a plurality of switch devices. The switching circuit couples a DC voltage to a primary side of the transformer and alternates polarities thereof so that an AC voltage is generated on a secondary side of the transformer to turn on the backlight blocks. The switch devices are respectively connected between one of the backlight blocks and the transformer, and the AC voltage turns the backlight blocks on when the switch devices are turned on.

7 Claims, 4 Drawing Sheets

BACKLIGHT MODULE DRIVER CIRCUIT

RELATED APPLICATIONS

The present application is based on, and claims priority from, Taiwan Application Serial Number 95104084, filed Feb. 7, 2006, the disclosure of which is hereby incorporated by reference herein in its entirety.

BACKGROUND

1. Field of Invention

The present invention relates to a driver circuit. More particularly, the present invention relates to a driver circuit used to turn on the backlight module of a liquid crystal display (LCD).

2. Description of Related Art

FIG. 1 shows the framework of an LCD 100. The LCD 100 comprises a pixel array 102 and a backlight module 104. The pixel array 102 and the backlight module 104 are stacked against each other, but they are separately disposed in FIG. 1 to be illustrated more clearly. The pixel array 102 comprises several pixel structures, and the backlight module 104 comprises several parallel cold cathode fluorescent lamps (CCFL) 106.

Generally, a scan-backlight control mode is used to display images for improving the quality of dynamic images. The whole pixel array 102 is divided into several display blocks, that is, display blocks 102*a*-102*d*. Similarly, the whole backlight module 104 is also divided into several backlight blocks 104*a*-104*d* that correspond to the display blocks 102*a*-102*d* positions. Each of the backlight blocks 104*a*-104*d* comprises at least one of the CCFLs 106. In the scan-backlight control mode, the display blocks 102*a*-102*d* are driven and charged according to a specific sequence. At the same time, the backlight blocks 104*a*-104*d* corresponding to the display blocks 102*a*-102*d* are also turned on according to the same sequence for displaying a complete image.

Thus, the CCFLs 106 in the backlight module 104 are respectively turned on and off based on blocks of CCFLs 106 rather than being turned on and off at the same time, and the amount of the backlight driver units will increase when the amount of the backlight blocks increases. FIG. 2 shows a driver circuit 200 for cooperating with the backlight module 104 shown in FIG. 1. It can be seen that each backlight block (104*a*, 104*b*, 104*c*, 104*d*) is driven by one switching circuit (204*a*, 204*b*, 204*c*, 204*d*) and one transformer (206*a*, 206*b*, 206*c*, 206*d*). The switching circuits 204*a*-204*d* are powered by a DC power supply 202. When one of the backlight blocks needs to be turned on, the switching circuit corresponding to the backlight block should be enabled.

Some problems can be seen from the framework of the driver circuit 200. For example, if there are too many units, such as switching circuits and transformers, in the driver circuit 200, the weight and volume of the flat panel display will be substantially increased, and the circuit will become more complicated. In addition, a great quantity of the switching circuits usually accompanies a great quantity of the switching motions, and the power consumed will be substantial. These problems will become obstacles for the development of LCD displays, and especially for small size LCD displays.

SUMMARY

It is therefore an objective of the present invention to provide a backlight module driver circuit used in a LCD.

It is another objective of the present invention to provide a backlight module driver circuit with less electronic units.

It is still another objective of the present invention to provide a smaller and lighter backlight module driver circuit.

It is still another objective of the present invention to provide a backlight module driver circuit with less power consumption.

According to one preferred embodiment, the backlight driver circuit comprises a transformer, a switching circuit and a plurality of switch devices. The switching circuit couples a DC voltage to a primary side of the transformer and alternates polarities thereof so that an AC voltage is generated on a secondary side of the transformer to turn on the backlight blocks. The switch devices are respectively connected between one of the backlight blocks and the transformer, and the AC voltage turns the backlight blocks on when the switch devices are turned on.

According to another preferred embodiment, the backlight driver circuit comprises a plurality of transformers, a switching circuit and a plurality of switch devices. The switching circuit couples a DC voltage to primary sides of the transformers and alternates polarities thereof so that an AC voltage is generated on secondary sides of the transformers to turn on the backlight blocks. The switch devices are respectively connected to the transformers, and the switch devices are used to determine whether the backlight blocks are turned on. When one of the switch devices is turned on, the transformer connected to the turned-on switch device outputs the AC voltage to turn on one of the backlight blocks.

According to another preferred embodiment, the flat display panel comprises a pixel array, a backlight module and a backlight module driver circuit. The pixel array comprises a plurality of display blocks. The backlight module comprises a plurality of backlight blocks, and the backlight blocks correspond the display blocks in position. The backlight module driver circuit is used to turn on the backlight blocks.

The backlight module driver circuit comprises a transformer, a switching circuit and a plurality of switch devices. The switching circuit couples a DC voltage to a primary side of the transformer and alternates polarities thereof so that an AC voltage is generated on a secondary side of the transformer to turn on the backlight blocks. The switch devices are respectively connected between one of the backlight blocks and the transformer, and the switch devices are used to determine whether the backlight blocks are turned on. When one of the switch devices is turned on, the backlight block connected to the turned-on switch device is turned on by the AC voltage.

BRIEF DESCRIPTION OF THE DRAWINGS

These and other features, aspects and advantages of the present invention will become better understood with regard to the following description, appended claims and accompanying drawings, where:

DESCRIPTION OF THE PREFERRED EMBODIMENTS

Figure 1:
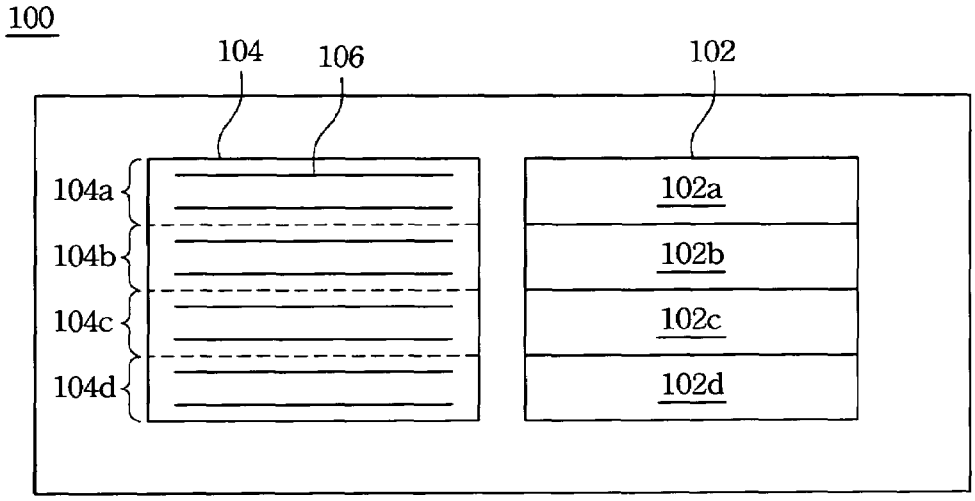
Fig. 1 (PRIOR ART)
FIG. 1 shows the framework of a conventional LCD.
Figure 2:
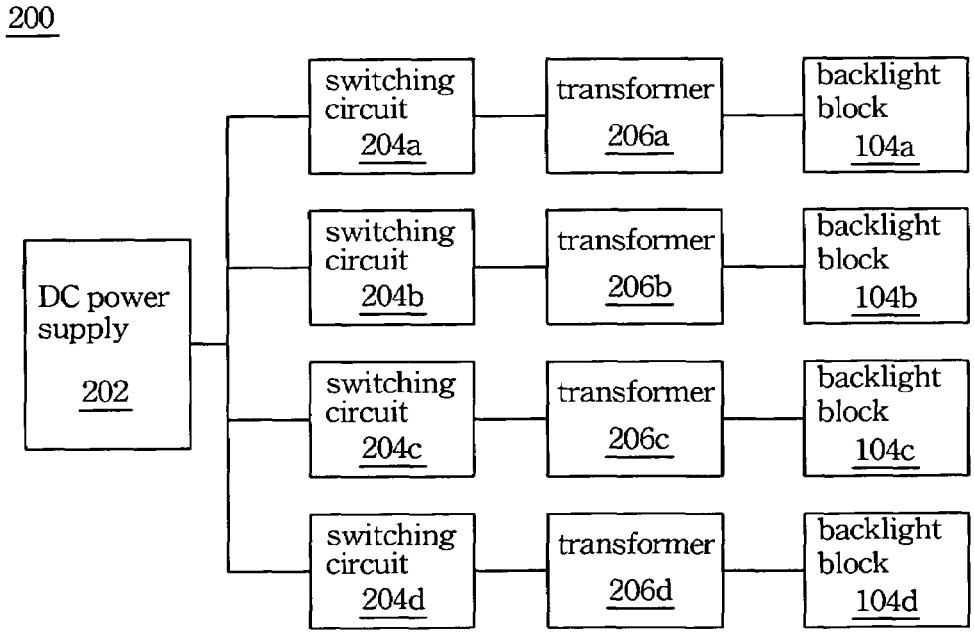
Fig. 2 (PRIOR ART)
FIG. 2 shows the framework of the backlight module driver circuit used in the conventional LCD.

Reference will now be made in detail to the preferred embodiments of the present invention, examples of which are illustrated in the accompanying drawings. Wherever possible, the same reference numbers are used in the drawings and the descriptions to refer to the same or like parts.

The scan-backlight control mode can be used to improve the quality of the image displayed on a LCD display. Therefore, each of the backlight blocks of the backlight module should cooperate with a driver unit, such as a switching circuit and a transformer, to implement the scan-backlight control mode in a conventional LCD, and the driver unit is able to turn on one of the backlight blocks it connects to. Thus, all of the electronic elements, the volume, the weight and the cost of the backlight module substantially increase. The basic concept of the present invention is to use less driver units to turn on more backlight blocks, and a switch device is used to determine which backlight block is turned on.

Figure 3A:
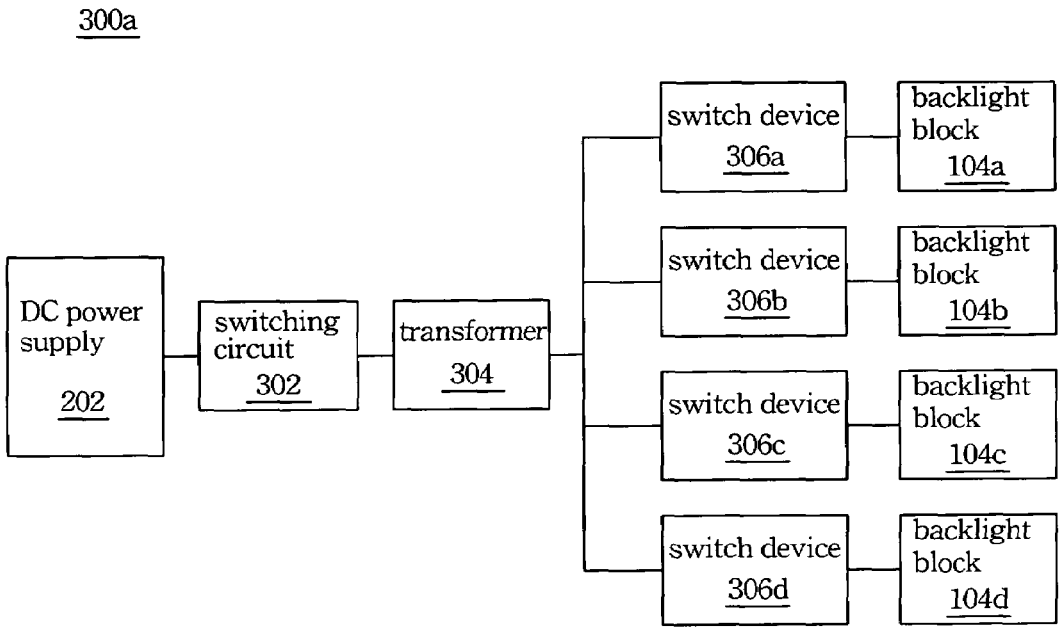
FIG. 3A shows the framework of a backlight module driver circuit according to one embodiment.

FIG. 3A shows framework 300*a* of a backlight module driver circuit according to an embodiment of the present invention. In FIG. 3A the backlight module driver circuit 300*a* has a switching circuit 302, a transformer 304 and switch device 306*a*-306*d*. The framework 300*a* is used in a flat panel display, such as a LCD display, and one of the purposes of the framework 300*a* is to respectively turn on backlight blocks 104*a*-104*d* included in the backlight module of the flat panel display.

In general, each of the backlight blocks 104*a*-104*d* includes several cold cathode fluorescent lamps (CCFLs) to be light sources, and the CCFLs should be powered by AC voltage. Hence, the switching circuit 302 couples a DC voltage to a primary side of the transformer 304 and alternating polarities thereof so that an AC voltage is generated on a secondary side of the transformer 304 to turn on the backlight blocks 104*a*-104*d*.

The AC voltage output from the transformer 304 is used to turn on all the backlight blocks 104*a*-104*d* in this embodiment. That is, all the backlight blocks can be turned on by only one driver unit, i.e. the switching circuit 302 and the transformer 304, and the amount of driver units can thus be effectively reduced. The backlight blocks 104*a*-104*d* are not turned on and off at the same time under the scan-backlight mode; therefore, switch devices 306*a*-306*d* are used to turn the backlight blocks 104*a*-104*d* on and off, respectively. The switch devices 306*a*-306*d* are respectively disposed between each of the backlight blocks 104*a*-104*d* and the transformer 304. For example, the two ends of the switch device 306*a* are respectively connected to the transformer 304 and the backlight block 104*a*. When the switch device 306*a* is tuned on, the backlight block 104*a* is turned on. Similarly, the switch devices 306*b*-306*d* are used to turn the backlight blocks 104*b*-104*d* on and off respectively.

Figure 3B:
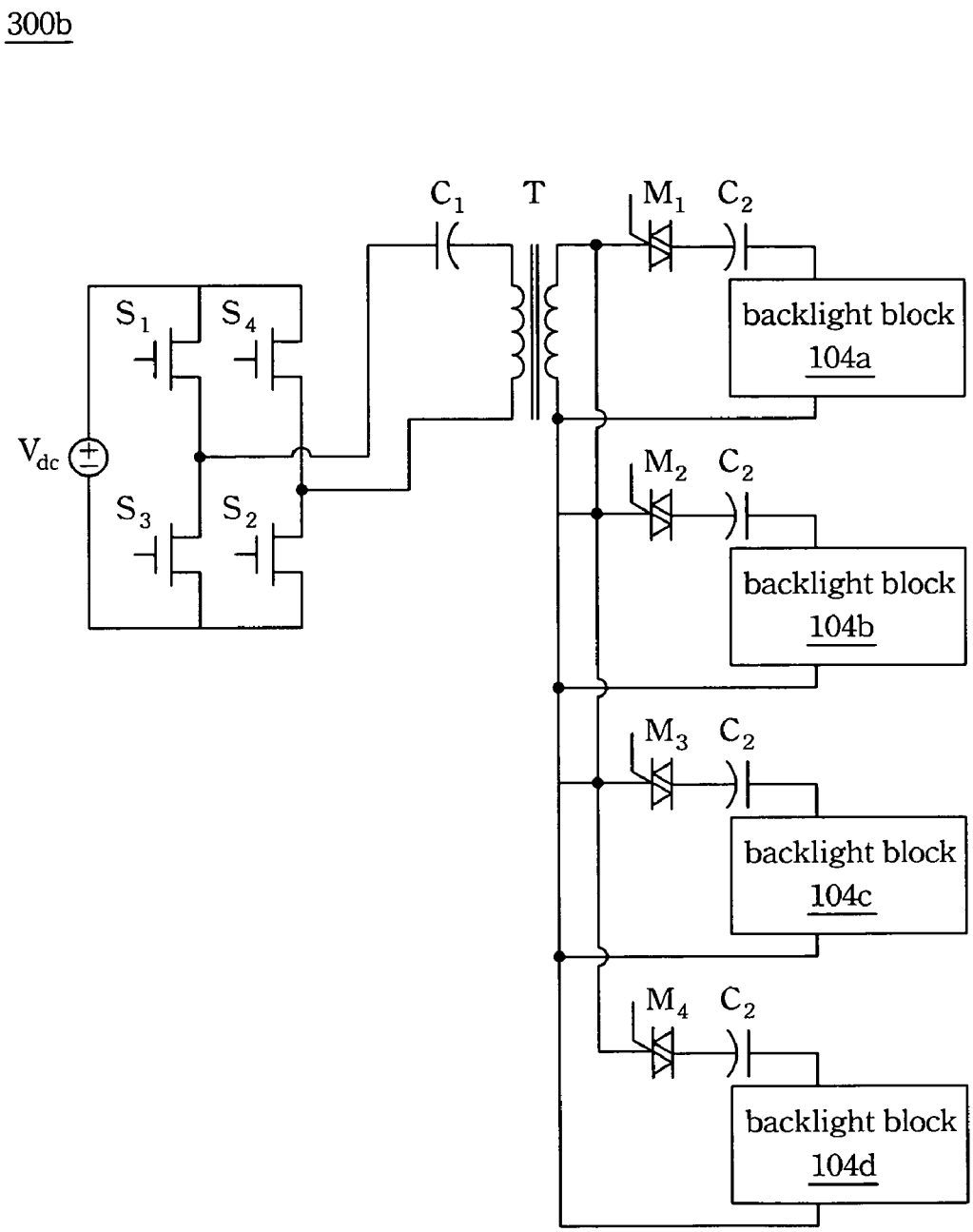
FIG. 3B shows the circuit diagram of the backlight module driver circuit.

FIG. 3B shows a backlight module driver circuit 300*b* used to implement the framework 300*a* shown in FIG. 3A. Referring to FIGS. 3A and 3B, it can be seen that inverting switches S1-S4, such as MOSFETs, are used to implement the switching circuit 302, a transformer T is used to implement the transformer 304, and triacs M1-M4 are used to implement switch devices 306*a*-306*d*. The inverting switch S1 and S3 cascade with each other and is then parallel with a DC power supply Vdc, and the inverting switch S2 and S4 cascade with each other and is then parallel with the DC power supply Vdc also. In the primary side of the transformer T, one endis connected to the contact between the inverting switch S1 and S3, and the other end is connected to the contact between the inverting switch S2 and S4. Assuming the inverting switch S1 and S2 is a switch set, and the inverting switch S3 and S4 is another switch set, when the two switch sets are quickly and alternately switched, an AC voltage used to turn on the backlight blocks 104*a*-104*d* is thus generated at the secondary side of the transformer T.

In this embodiment, the triacs M1-M4 are respectively cascaded between the secondary side of the transformer T and each of the backlight blocks 104*a*-104*d*, and are used to respectively turn the backlight blocks 104*a*-104*d* on and off. Other kind of controllable two-way conducting devices may be used instead of the triacs M1-M4. According to the foregoing description, when the triac M1 is turned on, the AC voltage generated at the secondary side of the transformer T turns the backlight block 104*a* on. Similarly, the triacs M2-M4 are used to turn the backlight blocks 104*b*-104*d* on and off respectively. Furthermore, capacities C1 and C2 may be respectively cascaded with the primary side and the secondary side of the transformer T for blocking the DC portion in the AC voltage.

Figure 4:
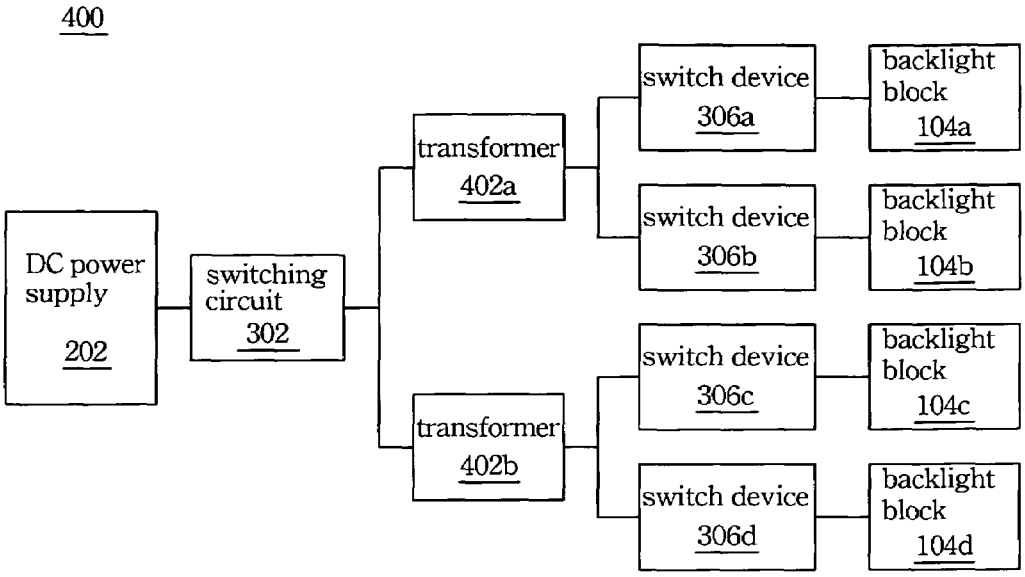
FIG. 4 shows the framework of a backlight module driver circuit according to another embodiment.

Giving consideration to the capacity limitations of a transformer, the AC voltages for different backlight blocks may be respectively provided by different transformers. FIG. 4 shows a framework 400 of a backlight module driver circuit according to another embodiment of the present invention. The framework 400 has a switching circuit 302, transformers 402*a* and 402*b*, and switch devices 306*a*-306*d*. In this embodiment, the AC voltage output from the transformer 402*a* is used to turn on the backlight blocks 104*a* and 104*b*, and the AC voltage output from the transformer 402*b* is used to turn the backlight blocks 104*c* and 104*d* on. The embodiment uses one switching circuit 302 and two transformers 402*a* and 402*b*. Thus, even though the framework 400 has one more transformer than the framework 300*a* shown in FIG. 3A, the capacity of both the transformers 402*a* and 402*b* can be smaller than the transformer 304 shown in FIG. 3A.

The switch devices 306*a*-306*d* are also used to turn the backlight blocks on and off respectively. The switch device 306*a* is disposed between the backlight block 104*a* and the transformer 402*a*, the switch device 306*b* is disposed between the backlight block 104*b* and the transformer 402*a*, the switch device 306*c* is disposed between the backlight block 104*c* and the transformer 402*b*, and the switch device 306*d* is disposed between the backlight block 104*d* and the transformer 402*b*. For example, the two ends of the switch device 306*a* are respectively connected to the transformer 402*a* and the backlight block 104*a*. When the switch device 306*a* is turned on, the backlight block 104*a* can be turned on by the AC voltage output from the transformer 402*a*. Similarly, switch devices 306*b*-306*d* are used to turn the backlight blocks 104*b*-104*d* on and off respectively, but the AC voltage of the backlight blocks 104*c* and 104*d* is output from the transformer 402*b*.

Similarly, the operation of the switching circuit 302 can be implemented by quickly switching several inverting switches in this embodiment. The switch devices 306*a*-306*d* may be triacs or other kind of controllable two-way conducting devices. Capacitors used to block the DC portion may be disposed on the primary side and the secondary side of the transformers 402*a* and 402*b*.

Figure 5:
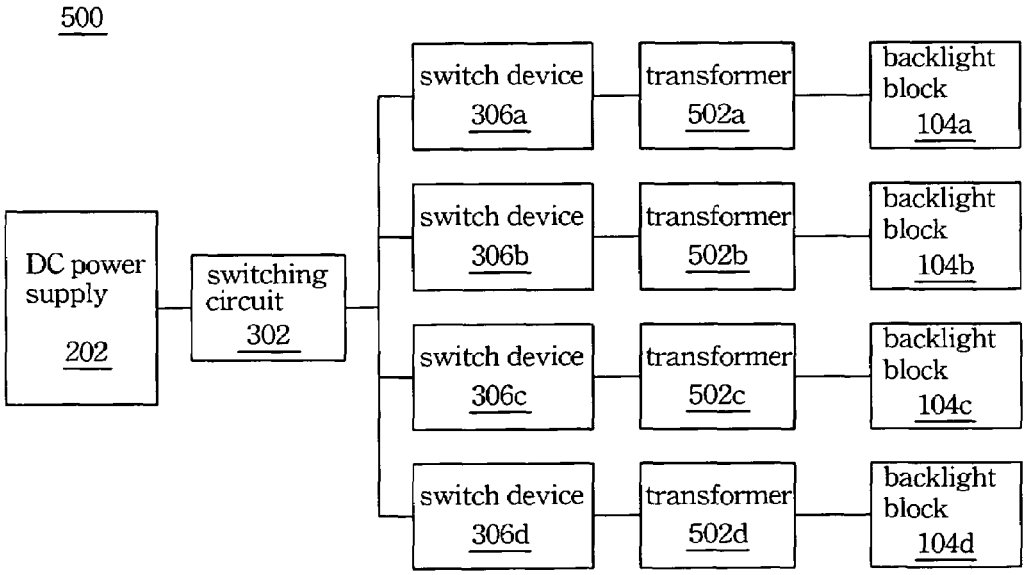
FIG. 5 shows the framework of a backlight module driver circuit according to another embodiment.

In the frameworks 300*a* and 400 respectively shown in FIGS. 3A and 4, the switch devices 306*a*-306*d* are respectively disposed on the secondary side of the transformers 304, 402*a* and 402*b*. But the switch devices may be disposed on the primary side of the transformers when the amount of transformers is identical to the amount of backlight blocks in the driver circuit framework. For example, the backlight module driver circuit framework 500 shown in FIG. 5. The framework 500 has a switching circuit 302, transformers 502*a*-502*d* and switch devices 306*a*-306*d*. The amount of transformers and the amount of backlight blocks in the framework 500 are identical, that is, the AC voltage output from the transformers 502*a*-502*d* are respectively used to turn the backlight blocks 104*a*-104*d* on. The driver unit in this embodiment has one switching circuit (the switching circuit 302) and four transformers (the transformers 502*a*-502*d*). Although the framework 500 has more transformers than the other circuit, the capacity of the transformers 502*a*-502*d* can be smaller.

The switch devices 306*a*-306*d* are also used to respectively turn the backlight blocks 104*a*-104*d* on and off. But in this embodiment, the switch devices 306*a*-306*d* are respectively disposed between each of the transformers 502*a*-502*d* and the switching circuit 302 to respectively enable and disable the transformers 502*a*-502*d*. For example, the two ends of the switch device 306*a* are respectively connected to the switching circuit 302 and the transformer 502*a*. When the switch device 306*a* is turned on, the backlight block 104*a* can be turned on by the AC voltage output from the transformer 502*a*. Similarly, The switch devices 306*b*-306*d* are used to enable and disable the transformer 502*b*-502*d* respectively, and the backlight blocks 104*b*-104*d* can be further turned on and off.

Similarly, the operation of the switching circuit 302 can be implemented by quickly switching several inverting switches in this embodiment. The switch devices 306*a*-306*d* may be triacs or other kind of controllable two-way conducting devices. Capacitors used to block the DC portion may be disposed on the primary side and the secondary side of the transformers 502*a*-502*d*.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A backlight module driver circuit used to turn on a plurality of backlight blocks in a backlight module, the backlight driver circuit comprising:

a plurality of transformers;

a switching circuit coupling a DC voltage to primary sides of the transformers and alternating polarities thereof so that an AC voltage is generated on secondary sides of the transformers to turn on the backlight blocks; and a plurality of switch devices respectively disposed between the switching circuit and one of the transformers, and the switch devices are used to determine whether the backlight blocks are turned on, wherein when one of the switch devices is turned on, the transformer connected to the turned-on switch device outputs the AC voltage to turn on one of the backlight blocks.

2. The backlight module driver circuit as claimed in claim 1, wherein the switch devices are respectively disposed between one of the transformers and one of the backlight blocks, when the switch devices are turned on, the transformers output the AC voltage to turn on the backlight blocks.

3. The backlight module driver circuit as claimed in claim 1, wherein the switch devices are not turned on and off at the same time.

4. The backlight module driver circuit as claimed in claim 1, wherein the switching circuit comprises two sets of inverting switches, and the polarities of the DC voltage are alternated by alternately switching the two sets of inverting switches.

5. The backlight module driver circuit as claimed in claim 4, wherein the two sets of inverting switches comprise a plurality of MOSFETs.

6. The backlight module driver circuit as claimed in claim 1, wherein the switch devices are triacs.

7. The backlight module driver circuit as claimed in claim 1, further comprising a plurality of capacitors respectively disposed at the primary side and the secondary side of the transformers, wherein the capacitors are used to block the DC portion of the AC voltage.

* * * * *